US006230338B1

(12) United States Patent
Kirsch

(10) Patent No.: US 6,230,338 B1
(45) Date of Patent: May 15, 2001

(54) NECK PAD

(75) Inventor: Jodi Kirsch, Chicago, IL (US)

(73) Assignee: Out of the Blue, Inc., Chicago, IL (US)

( * ) Notice: Subject to any disclaimer, the term of this patent is extended or adjusted under 35 U.S.C. 154(b) by 0 days.

(21) Appl. No.: 09/525,401

(22) Filed: Mar. 15, 2000

(51) Int. Cl.[7] ..... A45D 44/10
(52) U.S. Cl. ..... 4/523
(58) Field of Search ..... 4/515–523

(56) References Cited

U.S. PATENT DOCUMENTS 2,948,903 * 8/1960 Gilmer ..... 4/523
4,649,580 * 3/1987 Bastien ..... 4/519 X
4,763,364 * 8/1988 Morgan ..... 4/523
4,864,667 * 9/1989 Adams ..... 4/523 X
5,377,365 * 1/1995 Hakim ..... 4/519 X
5,924,145 * 7/1999 Najar ..... 4/523
5,978,980 * 11/1999 Flora ..... 4/523

* cited by examiner

*Primary Examiner*—Charles E. Phillips
(74) *Attorney, Agent, or Firm*—Irwin C. Alter

(57) ABSTRACT

An arrangement for the washing or other treatment of hair of a person which comprises a sink having a rim with an indentation, as is conventional. The rim indentation receives and supports the neck of the person. A flexible, resilient pad is carried on the rim within the indentation. The pad has a first end portion extending downwardly from the rim within the sink and a second end portion extending from the rim outside of the sink. The pad also has a central portion between the first and second end portions, which central portion rests in the indentation. The central portion has a width that is less than the respective widths of the first and second end portions.

9 Claims, 2 Drawing Sheets

NECK PAD

BACKGROUND OF THE INVENTION

In barber shops and beauty shops, customers often have their hair washed, dyed, curled, and provided with hair permanents, etc. as they lean backward in a chair with their neck resting on the edge of a sink. Typically, such a sink is of a special design having an indentation in its rim for receiving and supporting the neck of the customer. However, a hard sink rim can get quite uncomfortable for the customer over the long term as it presses against the neck and the back of the head, and can set off migraine headaches in some.

By this invention a special pad is provided which greatly increases the comfort of the customer during treatment of the hair, while at the same time, the pad is very unlikely to slip out of its desired position in such an indentation of the sink rim.

DESCRIPTION OF THE INVENTION

In particular, the invention of this application comprises a pad for a head and neck support, which comprises a flexible, resilient, flat member having first and second end portions and a central portion. The central portion is of less width than the first and second end portions.

Preferably, the pad comprises a viscous semi-solid polymer gel, which is surrounded and sealed by a flexible plastic outer wall. The pad of this invention also preferably defines concave, arcuate side edges adjacent to the central portion. Such side edges result in a central portion which is narrower than the two end portions, which causes the pad to be firmly retained without slippage within the indentation of the sink rim, with the respective first and second end portions extending from the rim, typically downwardly on the inside from the rim, and either downwardly or outwardly on the outside from the rim, with such outer end portion of the pad often lying over the top of a chair in which the patient rests.

It is also preferred for the central portion of the pad to be positioned asymmetrically on the pad, so that the second portion, extending outwardly from the sink rim, is larger than the first portion. The first inner pad end portion accordingly hangs downwardly on the inside of the sink wall under the rim, as a stabilizing feature, while the larger, second pad end portion can extend outwardly, to be in contact with the back of the neck and bottom of the head of the customer as she rests her neck on the rim of the sink. The viscous semi-solid polymer gel, coupled with a flexible plastic outer wall, provides a form fitting character to the pad, so that uncomfortable areas of high pressure against the neck and bottom of the head are significantly reduced, and the customer remains far more comfortable during a lengthy process of hair washing, hair dyeing, curling, straightening, or the like.

DESCRIPTION OF SPECIFIC EMBODIMENTS

Figure 1:
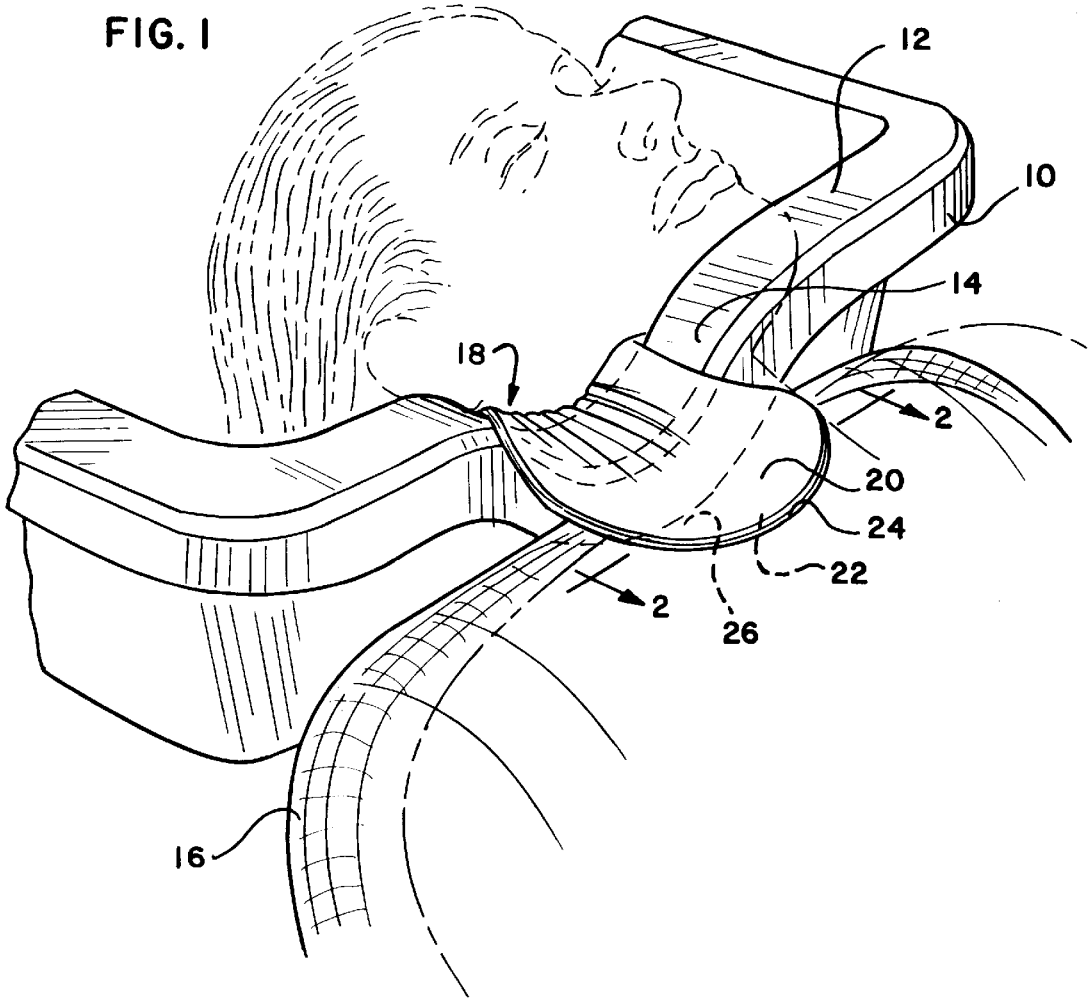
FIG. 1 is a perspective view of a sink having an indentation, with the pad of this invention resting in the indentation, and a portion of the outer end of the pad lying against the back of a chair.

Referring to the drawings, a conventional sink 10 is shown having a rim 12, which rim carries a concave, vertical indentation 14 for the purpose of receiving the back of the neck of a customer with her hair occupying the sink. Chair 16 is of course provided for the customer to sit and lie backwards as her hair is being treated.

In accordance with this invention, a pad 18 for neck and head support is provided. Pad 18 is a flexible, resilient, flat member as shown, being typically made from a pair of flexible plastic sheets 20, 22 such as plasticized polyvinylchloride, with the sheets being heat sealed at their mutual periphery 24, and being filled to form the flat pad with a viscous semi-solid polymer gel 26. Thus the pad is soft, compliant, and capable of fitting the contour of the customer's neck.

Figure 3:
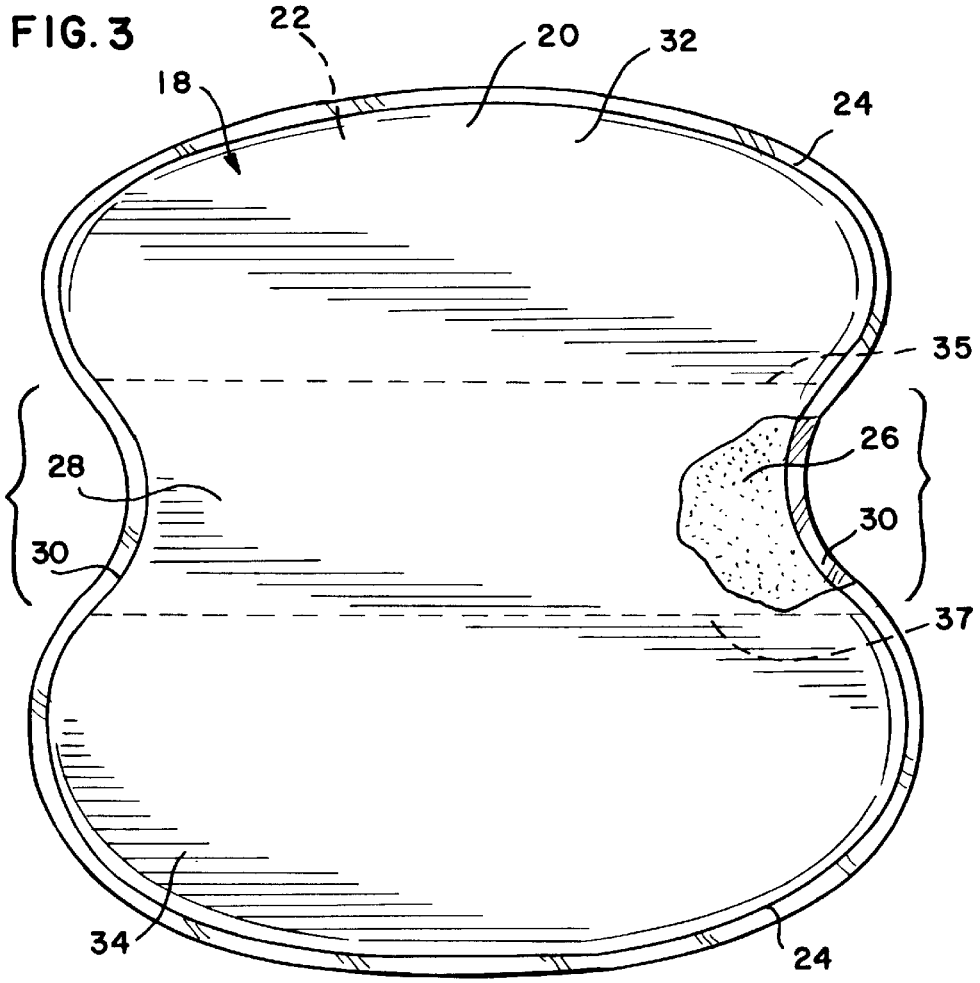
FIG. 3 is a plan view of the pad of FIG. 1 shown in a flat position.
Figure 4:
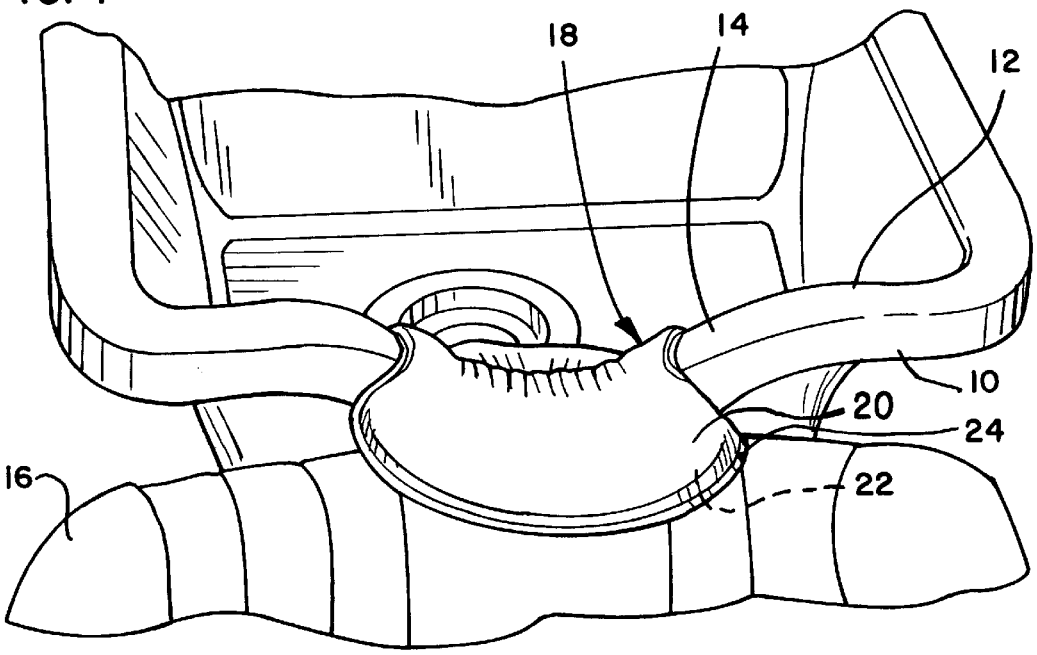
FIG. 4 is a top view similar to FIG. 1.

Also, pad 18 comprises a central portion 28 in which the pad defines concave, arcuate side edges 30 as shown in FIG. 3. This permits the pad to fit within the indentation 14 of the sink rim 12. The concave side edge portions 30 stabilize the positioning of pad 18 in the indentation 14 so that the pad does not easily slip from side forces such as the moving of the customer's head and neck, while at the same time it may be easily lifted off when it is not needed.

Figure 2:
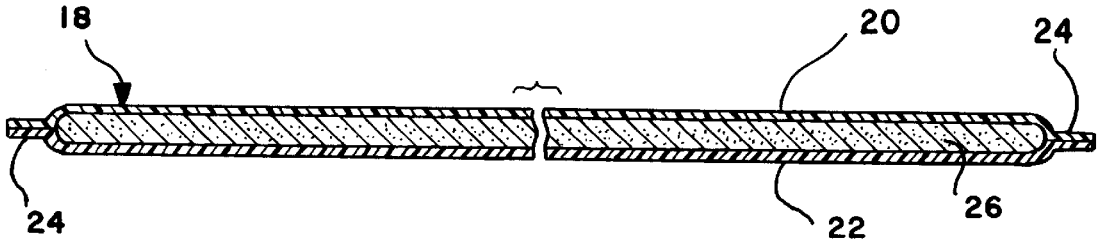
FIG. 2 is a fragmentary, transverse sectional view taken at the sink wall indentation and showing a cross section of the pad of this invention with one portion lying against the chair back, all taken along line 2—2 of FIG. 1.

Pad 18 also comprises first end portion 32 and second end portion 34, which end portions are separated by central portion 28. End portion 32 extends normally downwardly from sink indentation 14 within the sink as shown particularly in FIG. 2, when pad 18 is placed upon such a sink. Second end portion 34 extends outwardly from the sink rim and indentation 14, as shown in FIGS. 1 and 2, particularly to rest against the chair top if desired, as shown therein. This provides increased comfort to the customer who is in the chair and is being treated.

Preferably, second end portion 34 is larger than first end portion 32, since there is less need for a large portion of the pad to extend downwardly on the inside of the wall of sink 10 as shown in FIG. 2. Thus, the pad can be economically smaller, while second, outer end portion 34 is large enough to comfortably accommodate the neck and bottom of the head of the customer. End portions 32, 34 have substantially equal maximum widths as shown in FIG. 3.

End portions 32, 34 may be defined to approximately terminate at lines 35, 37, which may delineate the junction between the respective end portions 32, 34 and central portion 28.

Thus, an arrangement for the washing or other treatment of hair of person is disclosed, which comprises a conventional sink with an indented rim, and the pad of this invention, which provides substantial comfort preferably in the semi-solid polymer gel-filled form, and which is stable against lateral sliding forces so that the pad does not easily slide out of position, because of the reduced width of its central portion, and also because of the semi-solid polymer gel-filled structure.

The above has been offered for illustrative purposes only, and is not intended to limit the scope of the invention of this application, which is as defined in the claims below.

What is claimed:

1. An arrangement for the washing or other treatment of the hair of a person, which comprises a sink having a rim, said rim having an indentation in the rim for receiving and supporting the neck of the person; and a flexible, resilient pad carried on the rim within said indentation, said pad having a first end portion having a length extending downwardly from said rim within said sink, and a second end portion having a length extending from said rim outside of said sink, said pad also having a central portion between said first and second end portions which rests in said indentation, said central portion having a width that is less than the respective widths of said first and second end portions.

2. The arrangement of claim 1 in which said pad comprises a viscous semi-solid polymer gel, surrounded and sealed by a flexible plastic outer wall.

3. The arrangement of claim 2 in which said plastic outer wall comprises plasticized polyvinylchloride.

4. The arrangement of claim 1 in which said pad defines concave, arcuate side edges adjacent to said central portion.

5. The arrangement of claim 1 in which said central portion is positioned asymmetrically on said pad, whereby the second portion is larger than the first portion.

6. The arrangement of claim 1 in which said first and second portions have substantially equal maximum widths.

7. The arrangement of claim 1 in which said pad comprises of viscous semi-solid polymer gel, surrounded and sealed by a flexible plastic outer wall, said pad defining concave, arcuate side edges adjacent to said central portion.

8. The arrangement of claim 7 in which said central portion is positioned asymmetrically on said pad, whereby the second portion is larger than the first portion.

9. The arrangement of claim 8 in which said first and second portions have substantially equal maximum widths.

* * * * *